US007156687B1

(12) United States Patent
Chiang et al.

(10) Patent No.: US 7,156,687 B1
(45) Date of Patent: Jan. 2, 2007

(54) INSULATION DISPLACEMENT CONNECTION CONNECTOR ASSEMBLY WITH CABLE POSITIONING RECESSES

(75) Inventors: Shu Man Chiang, Tucheng (TW); Chung Hsin Huang, Tucheng (TW); Yi Chiu Kao, Tucheng (TW); Yu Hung Su, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/305,105

(22) Filed: Dec. 19, 2005

(30) Foreign Application Priority Data

Dec. 23, 2004 (TW) ..... 93220763 U

(51) Int. Cl.
*H01R 4/24* (2006.01)
*H01R 4/26* (2006.01)
*H01R 11/20* (2006.01)

(52) U.S. Cl. ..... 439/404; 439/400

(58) Field of Classification Search ..... 439/404, 439/399–401, 407

See application file for complete search history.

(56) References Cited

U.S. PATENT DOCUMENTS

| | | | | |
|---|---|---|---|---|
| 4,066,316 | A * | 1/1978 | Rollings | 439/404 |
| 4,441,779 | A * | 4/1984 | Foederer et al. | 439/404 |
| 5,915,990 | A * | 6/1999 | Beer et al. | 439/417 |
| 6,579,117 | B1 * | 6/2003 | Nagata | 439/456 |
| 6,866,538 | B1 * | 3/2005 | Lee | 439/404 |

FOREIGN PATENT DOCUMENTS

EP 382039 A1 * 8/1990

* cited by examiner

*Primary Examiner*—Hae Moon Hyeon
(74) *Attorney, Agent, or Firm*—Rosenberg, Klein & Lee

(57) ABSTRACT

An insulation displacement connection (IDC) connector assembly includes an IDC connector and external cables. The cables are inserted in the IDC connector through passageways disposed in a surface of the IDC-connector to be terminated to the IDC connector. A positioning recess is defined in the top surface of the IDC connector corresponding to each cable and each communicates with the corresponding passageway and is exposed to surfaces adjacent to the surface mentioned above.

1 Claim, 5 Drawing Sheets

INSULATION DISPLACEMENT CONNECTION CONNECTOR ASSEMBLY WITH CABLE POSITIONING RECESSES

BACKGROUND OF THE INVENTION

1. Field of the Invention

The present invention generally relates to an insulation displacement connection (IDC) connector, and more especially to an IDC connector for terminating external cables and reliably positioning the cables therein thereby reducing the space occupied by the cables.

2. The Related Art

An IDC connector is a kind of connector with IDC contacts that displace insulation of cables and then make electrical connection with conductors enwrapped by the insulation.

Traditional IDC connector assembly comprises an IDC connector and a plurality of external cables terminated thereto. The IDC connector generally includes an insulative housing which defines a plurality of contact receiving slots and a plurality of electrical IDC contacts that pierce into and electrically connect the cables when contacts are inserted in the contact receiving slots.

When the traditional IDC connector assembly is installed in an electronic device, the cables usually need to be bent to connect other electrical components located in a different position of the electronic device. However, the bent cables extend by outer surfaces of the IDC connector, which occupies a considerable large space. Furthermore, the IDC connector has no special positioning mechanism to position the cables, thereby creating the problem that the cables may be wiggled and twisted frequently which can result in that the cables are liable to depart from the IDC connector or other electrical components.

SUMMARY OF THE INVENTION

The present invention is directed to IDC connector assembly comprising an IDC connector and at least one cable. The IDC connector is equipped with an insulative housing and at least one electrical contact that has an insulative displacement section. The insulative housing has a top surface and a plurality of side surfaces. At least one contact receiving slot is defined in the insulative housing and opens to at least one side surface. At least one passageway and at least one positioning recess are disposed in the top surface with the passageway communicating with the contact receiving slot and the positioning recess, and the positioning recess being exposed to at least one side surface of the insulative housing. One end of the cable is inserted in the contact receiving slot through the passageway, and the other end of the cable extends out of the passageway and is bent and positioned in the positioning recess. The electrical contact is inserted and secured in the contact receiving slot with the insulation displacement section piercing into the cable. In the assembly, as the cable can be bent to be positioned and retained in the insulative housing thereby the space occupied by the cable is reduced.

Preferably, the positioning recess comprises a transverse positioning recess exposed to one of the side surfaces and a lengthwise positioning recess exposed to one different side surface to enable the cable to be bent and positioned in a required direction.

Advantages of the present invention will become more apparent from the following detailed description when taken in conjunction with the accompanying drawings.

DETAILED DESCRIPTION OF THE PREFERRED EMBODIMENT

In order to illustrate the present invention particularly, including technology, structure trait, aims and efficiency, a detailed explanation of a preferred embodiment of the present invention will be given thereinafter, with reference to the attached drawing, for better understanding thereof to those skilled in the art.

Figure 1:
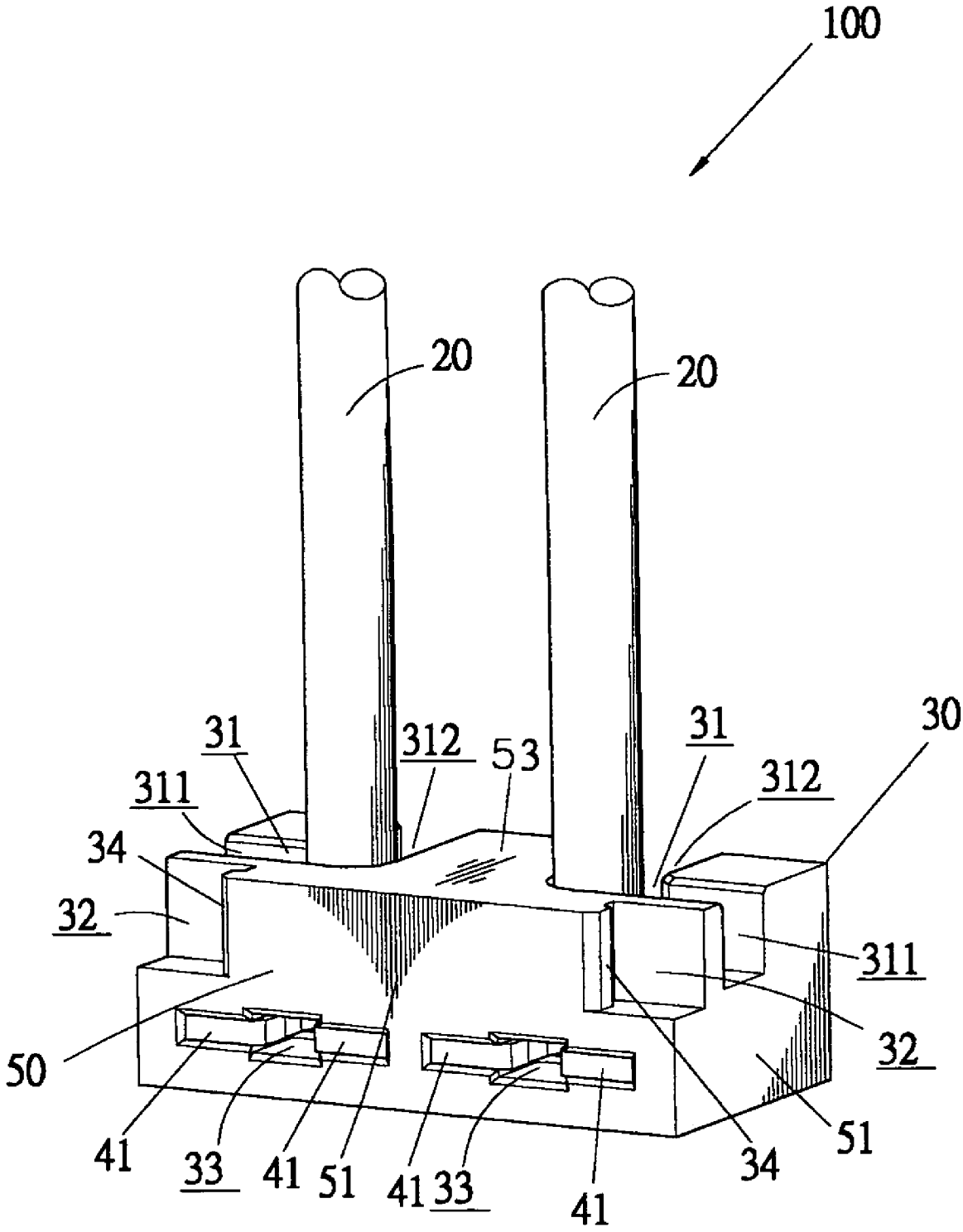
FIG. 1 is an assembled perspective view of an IDC connector assembly according to the present invention, illustrating external cables being terminated to the IDC connector.

Referring to FIG. 1, an IDC connector assembly 100 according to the present invention comprises an IDC connector 50 and a pair of external cables 20 terminated to the IDC connector 50.

Figure 2:
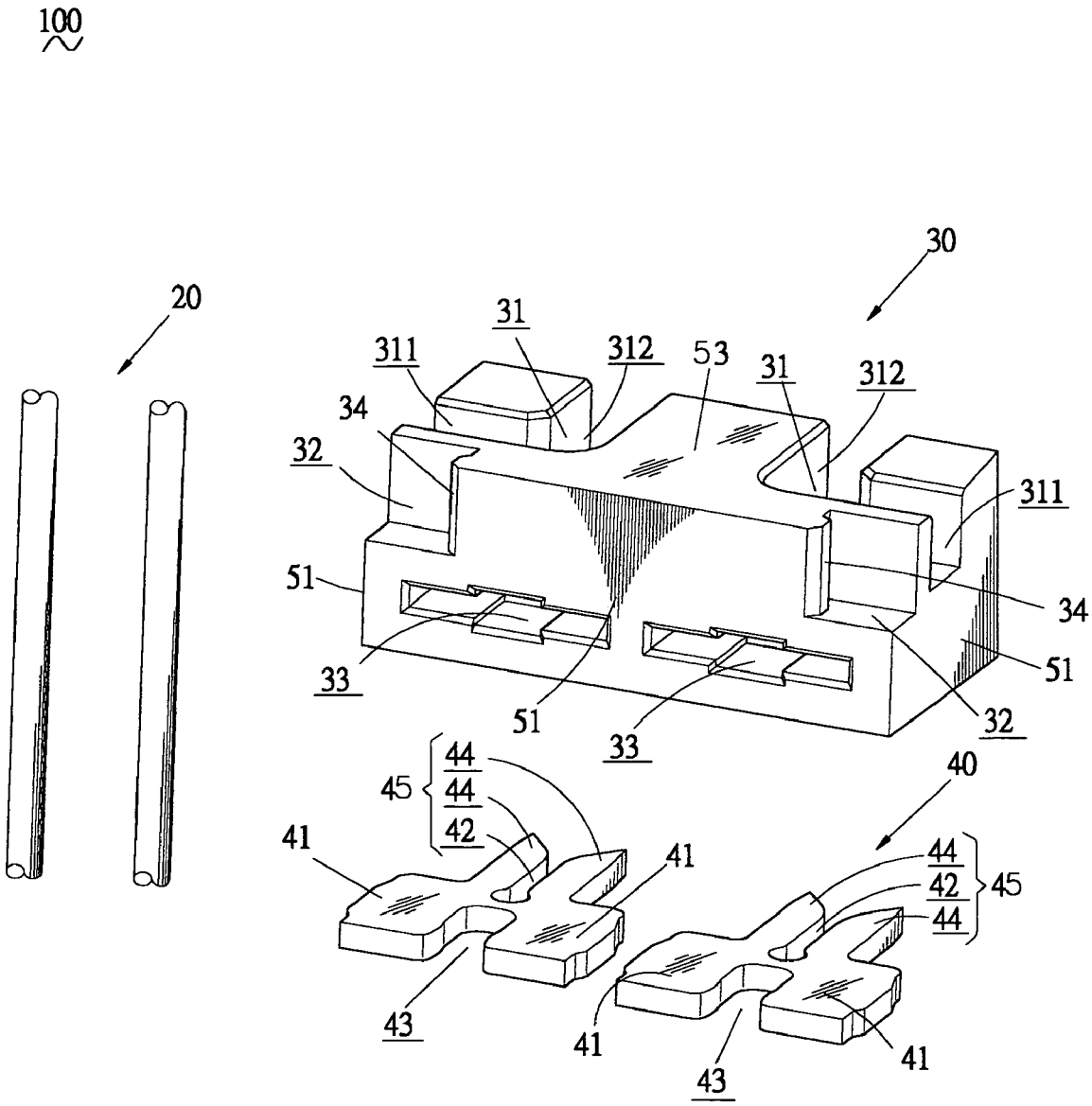
FIG. 2 is an exploded perspective view of the IDC connector assembly of FIG. 1.

With reference to FIG. 2, the IDC connector 50 for terminating the external cables 20 is equipped with an insulative housing 30 and a pair of electrical contacts 40 that have insulative displacement sections 45 respectively. The insulative housing 30 has a top surface 53 and a plurality of side surfaces 51. A pair of contact receiving slots 33 is defined extending through the insulative housing 30 and opens to the front and the rear side surfaces 51. Referring to FIG. 2 in conjunction with FIG. 4, a pair of passageways 313 is disposed in the top surface 53 of the insulative housing 30 communicating with the corresponding contact receiving slots 33. A pair of positioning recesses 31 is disposed on the top surface 53 of the insulative housing 30 corresponding to respective cables 20 and communicating with the corresponding passageways 313. Each positioning recess 31 includes a transverse positioning recess 311 and a lengthwise positioning recess 312, with the transverse positioning recess 311 exposed to the left or right side surface 51, and the lengthwise positioning recess 312 exposed to the rear side surface 51. The front side surface 51 of the insulative housing 30 acting as a mating face is provided with a pair of engaging recesses 32 and a pair of latching blocks 34 in opposite side thereof for mating with and interlocking with a mating connector (not shown).

Figure 3:
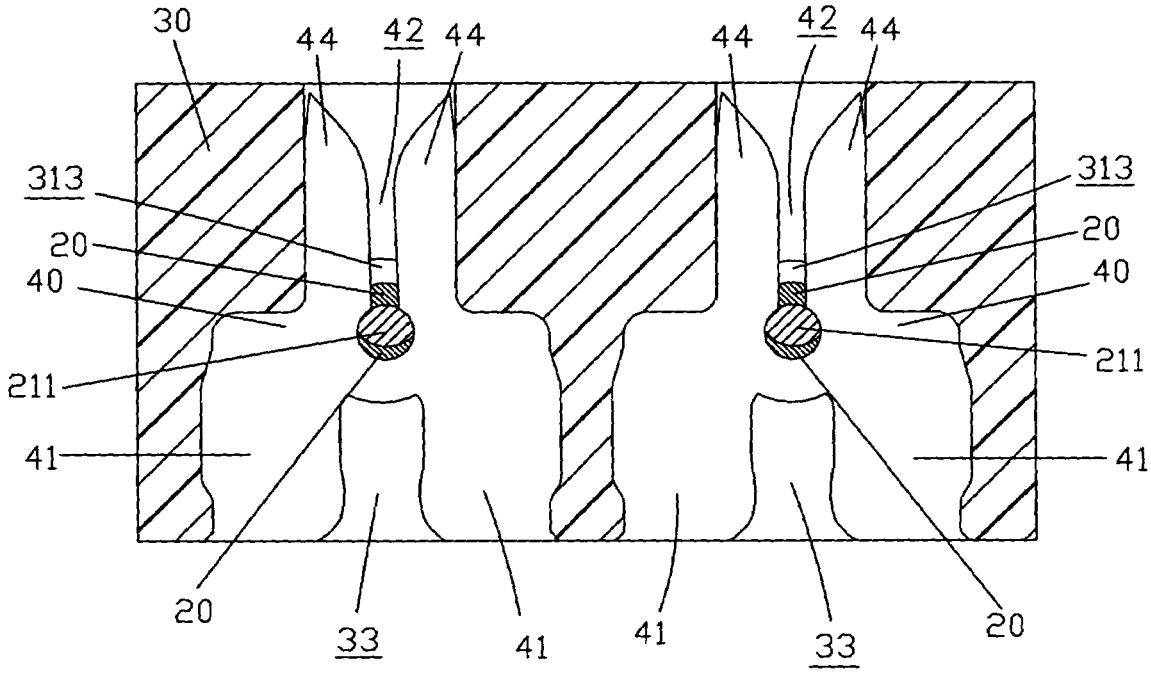
FIG. 3 is a cross-sectional view of the IDC connector assembly of FIG. 1 showing the cables being terminated to the IDC connector in more detail.

Referring to FIG. 2 in conjunction with FIG. 3, Each electrical contact 40 has an insulation displacement section 45 which includes a pair of piercing arms 44 and a conductor termination slot 42 formed between the piercing arms 44, and two retention-sections 41 that engage with the corresponding contact receiving slot 33 to retain the electrical contact 40 in the contact receiving slot 33. The piercing arms 44 are used for piercing into the corresponding cable 20 with conductor 211 of the cable 20 being received in the conductor termination slot 42 thereby electrically connecting with the cables 20. A clamp slot 43 is formed between the two retention-sections 41 of each electrical contact 40 for clamping a mating contact of a mating connector (not shown) when the IDC connector 50 is mated with the mating connector.

Figure 4:
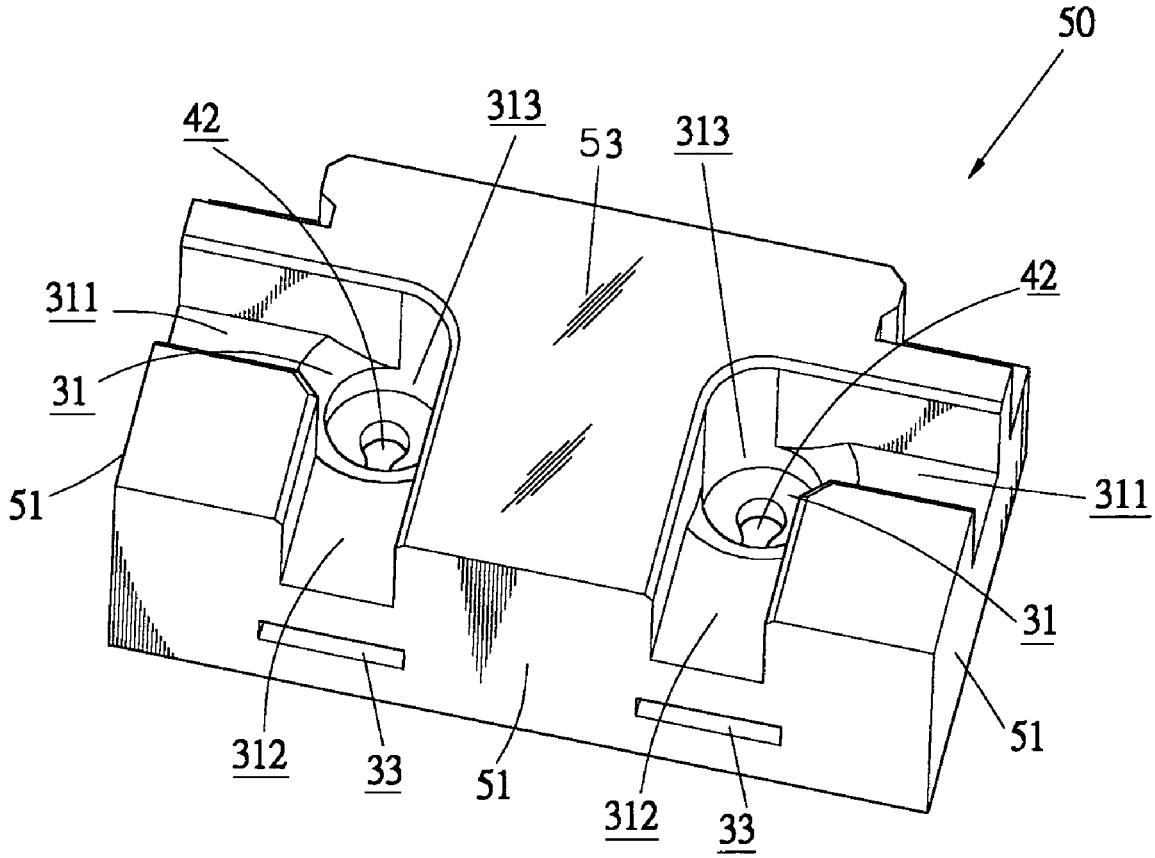
FIG. 4 is an assembled perspective view of the IDC connector shown in FIG. 1.

With further reference to FIGS. 1, 3 and 4, when assembling, one end of each cable 20 is inserted into the corresponding contact receiving slot 33 through the passageway 313, and the other end of the cable 20 extends out of the passageway 313. The electrical contacts 40 are then inserted in the contact receiving slots 33 from the front openings of the slots 33 with insulation displacement sections 45 piercing into the cables 20.

Figure 5:
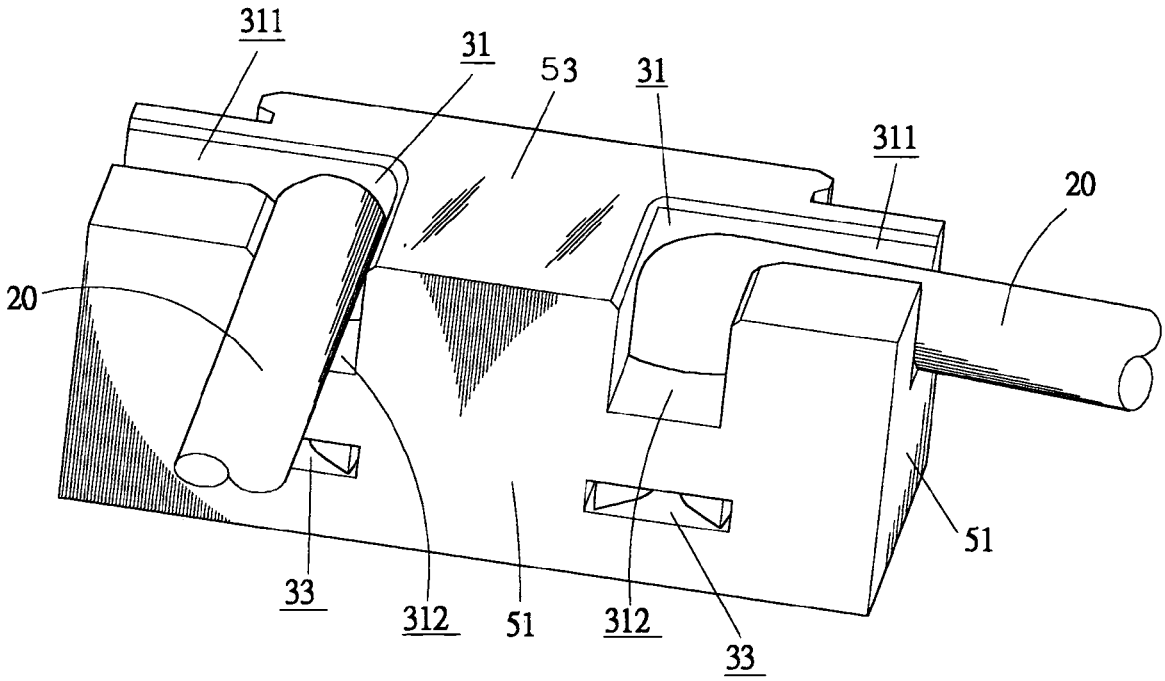
FIG. 5 is another assembled perspective view of the IDC connector assembly, illustrating the cables being bent and positioned in the IDC connector.

Referring to FIG. 5, when the cable 20 extending out of the IDC connector 50 is required to extend in the left or right direction to connect external components located on left or right of the IDC connector 50, the cable 20 can be bent and positioned in the transverse positioning recess 311. On the same principle, when the cable 20 is required to extend rearward, the cable 20 can be bent and positioned in the lengthwise positioning recess 312. The cables 20 are thus positioned to be prevented from wiggling and twisting, and the space occupied by the cables 20 is reduced.

While the present invention has been described with reference to a specific embodiment thereof, the description is illustrative and is not to be construed as limiting the invention. Various modifications to the present invention may be made to the preferred embodiment by those skilled in the art without departing from the true spirit and scope of the invention as defined by the appended claims.

What is claimed is:

1. An insulation displacement connection connector assembly comprising:

an insulative housing having:

a top surface; and a plurality of side surfaces, one of said side surfaces being a front side surface, said front side surface being provided with an engaging recess formed at each top surface corner, each said engaging recess having a latching block for interlocking with a mating connector; and at least one contact receiving slot being defined in the insulative housing and opening to at least said front side surface, a passageway and a pair of positioning recesses corresponding to each at least one contact receiving slot, said positioning recesses being disposed in said top surface, the passageway communicating with the at least one contact receiving slot, each positioning recess communicating with the passageway and being exposed to at least one of said side surfaces, one of said pair of positioning recesses being transverse to said front side surface and the other being parallel to said front side surface; and at least one cable, one end of the cable being inserted into said at least one contact receiving slot through said passageway, the other end of the cable extending out of the passageway and being bent to be positioned in one of the positioning recesses; and at least one electrical contact having an insulation displacement section, the electrical contact being inserted and secured in the at least one contact receiving slot with the insulation displacement section piercing into the cable.

* * * * *